United States Patent [19]

Ames

[11] Patent Number: 4,872,557

[45] Date of Patent: Oct. 10, 1989

[54] NESTABLE, STACKABLE CONTAINERS

[75] Inventor: Douglas A. Ames, Huntington Beach, Calif.

[73] Assignee: Transphase Systems, Inc., Huntington Beach, Calif.

[21] Appl. No.: 696,529

[22] Filed: Jan. 30, 1985

[51] Int. Cl.[4] ..... B65D 21/02

[52] U.S. Cl. ..... 206/504; 206/509; 815/10; 220/72

[58] Field of Search ..... 206/501, 504, 509; 215/10; 220/72; 446/125, 128; 52/593, 594

[56] References Cited

U.S. PATENT DOCUMENTS

| | | | |
|---|---|---|---|
| D. 124,755 | 1/1941 | Voorhis | 206/509 |
| 353,600 | 11/1886 | Sloan | 215/10 |
| 1,920,515 | 8/1933 | Marsden | 215/10 |
| 2,488,611 | 11/1949 | Stallings | 215/10 |
| 3,001,564 | 9/1961 | Hopkins | 206/509 |
| 3,374,917 | 3/1968 | Troy | 446/125 |
| 3,552,599 | 1/1971 | Redding | 220/72 |
| 4,060,952 | 12/1977 | Hernandez | 446/125 |

FOREIGN PATENT DOCUMENTS

| | | | |
|---|---|---|---|
| 2049989 | 4/1972 | Fed. Rep. of Germany | 220/72 |
| 2704152 | 8/1978 | Fed. Rep. of Germany | 206/504 |
| 2732881 | 2/1979 | Fed. Rep. of Germany | 220/72 |
| 1401332 | 4/1965 | France | 206/501 |
| 869392 | 5/1961 | United Kingdom | 215/10 |
| 1049484 | 11/1966 | United Kingdom | 446/128 |
| 1113988 | 5/1968 | United Kingdom | 206/509 |

*Primary Examiner*—George E. Lowrance

*Attorney, Agent, or Firm*—Watson, Cole, Grindle & Watson

[57] ABSTRACT

A nestable, stackable container is formed from a container body having a forward portion with a convex surface adapted to mate with the concave surface of the rearward portion of the next adjacent container. The container also has rasied male die parts on its top wall adapted to mate with indented, female die parts on the bottom wall of an upwardly adjacent container.

11 Claims, 2 Drawing Sheets

NESTABLE, STACKABLE CONTAINERS

The present invention relates generally to the container art, and more particularly to the art of containers that are liquid impermeable and are utilized to hold fluent and viscous materials. Containers according to the present invention have been found specifically useful in retaining highly viscous materials.

The art of container design is a broad one. Often the features of the container are originated because of the specific material with which the container will be filled, or the particular use to which the container is to be put. Both the type of material and the utilization of the containers according to my invention have been instrumental in the ultimate form of the containers, which are designed for their preferred use in holding a eutectoid salt composition. In general overview, eutectoid salt compositions are a mixture of various salts which, in combination, have a freezing and melting point or range at which the composition releases or retains a significant heat of fusion. At such freezing and melting point, an appreciable quantity of heat—or when the freezing point is less than the ambient temperature—coolness, can be stored. More specifically, the containers disclosed herein are most useful when used to hold eutectoid salt compositions of relatively low freezing/melting points, e.g., between about 40° and 55° F.

In a eutectoid salt, coolness storage composition, it is desirable that the composition be contacted by a medium, generally water, which is used to freeze the salt composition in its containers. Then, when it is desired to chill a medium, that medium is passed about the frozen salts and cooled thereby. With this use of the containers established, those containers should be in a form such that they are self-stacking and in assembly constitute a structure that will be substantially able to support itself. Further, in order to enhance the utility of the resulting structure or rack, the containers should interlock in a manner such that the structure is as compact as possible, while permitting the flow of the fluid, such as water or air, to be directed through the structure of containers to impart or receive coolness from the containers'contents.

Another problem that is present in providing containers to hold eutectoid salt compositions is occasioned by the nature of the material, itself. Such compositions are viscous and must be pumped from mixing vats into the containers. Because, for purposes of economy, it is requisite that filling of the containers be carried out at as high of speed as possible, a container must not have a shape that will trap air when the salt composition is pumped into it under high pressure.

It is, therefore, the important object of my invention to provide a container that is particularly adapted to receive viscous materials pumped into the container under high pressure, which container will be uniformly occupied by the viscous composition with a minimum of trapping of air therewithin.

It is another object of my invention to provide a container that will present a coherent, substantially self-supporting structure when individual containers thereof are stacked and nested, which structure will nevertheless permit the passage of fluid about and between each of the containers that make up the structure.

It is another object of my invention to provide a container which, in a self-supporting structure, will be compact and resistant to degrodation of the integrity of the structure.

As a summary of my invention, in one form it may be described as a container capable of retaining a fluid therein and having top and bottom walls joined by continuous side walls extending around the periphery of the container body. The bottom wall is formed with either male or female die parts adapted to cooperate with mating die parts on the top wall of another container. Generally, it has been found advantageous to provide all of the top walls of the containers with male die parts and the bottom walls with female die parts. The container has a forward portion which is in the form of a generally convex surface that constitutes an extension of the side walls of the container and which contains a mouth through which access to the contents of the container is gained and through which the container is filled. The container also has a rearward portion which is formed with a generally concave surface that constitutes an extension of the side walls and which conforms generally to the convex surface of the forward portion of the container. In this manner, containers according to my invention are stackable by mating of the male and female die parts on the top and bottom walls, and nestable by juxtaposition of the forward, convex portion of one container with the concave surface of the rearward portion of another container.

In preferred forms, the nesting feature is accomplished by having the forward portion of the container terminate in a mouth that is at the center of the gradually sloping, generally convex surface. At the center of the generally concave surface of the rearward portion of the container, which concave surface has a slope that advantageously matches that of the convex front portion of the container, is an indentation or notch adapted to receive the protruding mouth of the container. In this manner adjacent containers can nest, the rearward portion of one being shaped to the form of the forward portion of the following container.

The heat transfer feature of my invention is advantageously accomplished by having the male parts that protrude from either the top or bottom walls of the container be hollow, so that no portion of these walls is inhibited from presenting an area of salt composition to the surrounding fluid by the male mating members. There is no problem in forming the indentations that constitute the female mating members so that they will present a surface area containing salt composition to the male member and the ambient fluid. Most preferably, the upwardly facing, top wall of the container has hollow male mating members. In this manner the lowermost of any group of containers will rest on a major area of its bottom wall, rather than on its male protrusions, and the male die parts, being hollow, contain eutectoid salt composition.

When a rack of containers according to the present invention is in place, the male mating parts will extend away from the plane of their wall, preferable the top walls of the containers, by a difference greater than the depths of the indentations that constitute the female mating members. In this configuration, vertically adjoining containers will be separated from each other by a distance equal to the difference between the upward dimension of the male members and the inward dimension of the female members. In this manner vertically adjoining containers are separated from eachother by, for example, about one-half inch, which is a distance sufficient to permit fluid to flow between the containers and either to cool or freeze the eutectoid salt composition within the containers, or to be cooled by that salt composition.

It is still another feature of my invention that the containers in a rack can be stacked either in parallel or perpendicular configurations. When the mating members are symmetrical, for example, if the male member terminates in a protuberance similar in design to that of a "+" mark, and the female indentation is of the same shape, the containers may be arranged in alternating tiers that vary from each other in direction by 90°. In this manner parallel rows of containers can be alternately spaced by other parallel rows of containers displaced by 90° from the first set of parallel rows. By such alternate spacing, or spacing at other intervals, rigidity can be added so that the integrity of the rack will be maintained without the necessity of using separate supporting members.

These and other features and advantages of the herein disclosed invention will become more apparent when viewed in connection with a preferred embodiment and best mode of the invention as described hereinafter and illustrated in the accompanying drawings, in which.

Figure 1:
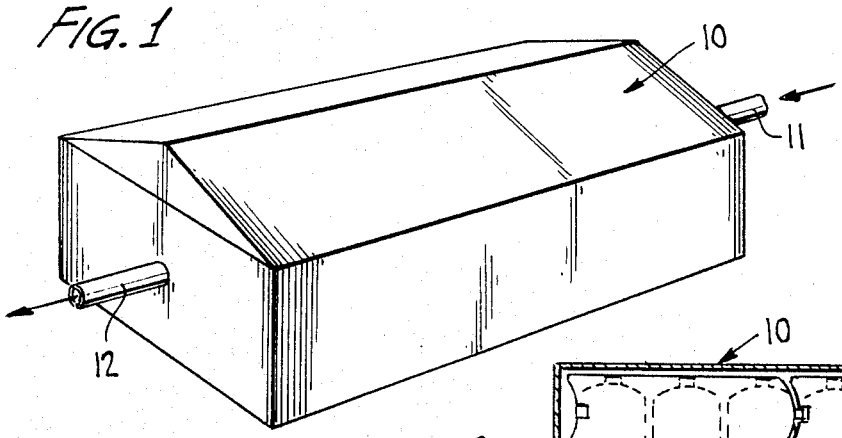
FIG. 1 is a diagrammatic view of a housing for the containers.
Figure 2:
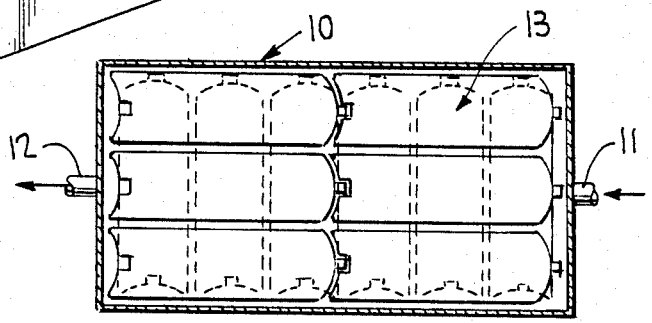
FIG. 2 is a plan view of several rows of containers in the housing of FIG. 1.

Referring now to the best mode illustrated in the drawings, and in particular to FIGS. 1 and 2 thereof, the containers of my invention may be housed above grade in an enclosure 10 as illustrated in FIG. 1 in a schematic manner. The enclosure 10 is shown to have an inlet port 11 and outlet port 12 for the purposes of illustration only, as it will be recognized that the ports and structure of the enclosures will often be more complex than those shown. Indeed, at present it is preferred that the entire enclosure be located below grade. It will thus be seen that the enclosure 10 forms no part of the invention disclosed and claimed herein.

In FIG. 2, for illustration only, containers 13 are shown in position within the enclosure 10. In actual practice, there may well be hundreds of vertical rows of containers, the number of which is defined by the size of the containers and the amount of fluid required to be cooled, as well as by other factors. As shown in FIG. 2, however, fluid, preferably water, enters the enclosure 10 through inlet port 11, passes around and about the containers 13, and then exits the enclosure through outlet port 12. In this manner, coolness is either imparted to the eutectoid salt composition within the containers by the water ,r the water itself is chilled. Which of those functions will be performed depends, of course, on the relative temperatures of the water and the salt composition.

Figure 3:
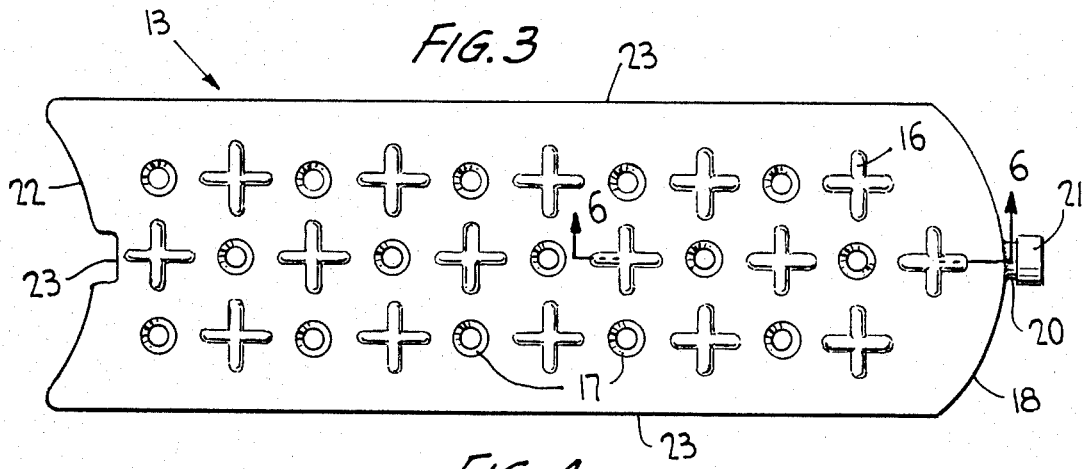
FIG. 3 is a top plan view of a container according to my invention.
Figure 4:
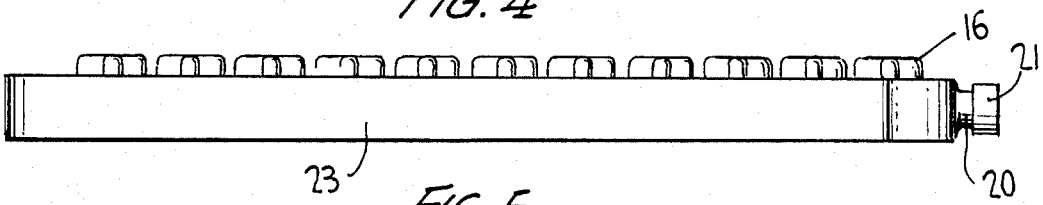
FIG. 4 is a side elevation of the container of FIG. 3.
Figure 5:
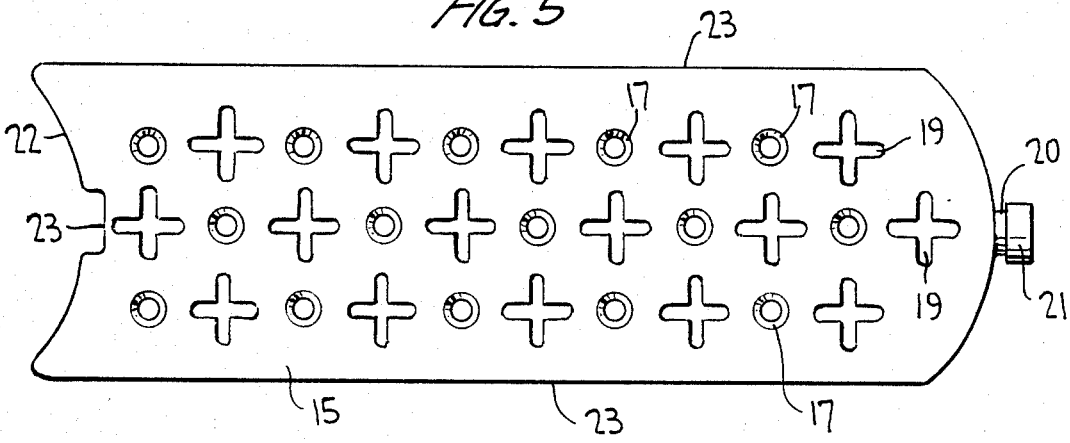
FIG. 5 is a bottom plan view of the container of FIG. 3.

A preferred embodiment of the container according to the present invention is best illustrated in overall view in FIGS. 3, 4 and 5. There it will be seen that the container 13 is formed with a top wall 14 and a bottom wall 15. In the top wall at distances conveniently spaced from each other are male mating members 16 which are shown to be generally in the form of a plus (+) sign. These male mating members or die parts will be illustrated in greater detail hereinafter. Also conveniently spaced along the top wall 14 of the container 13 are a series of support posts 16 which, as will be apparent from a comparison of FIGS. 3 and 5, extend through the container and, in most preferred form, are simply locations where the containers are open to the passage of fluid through half of the support posts, which are sealed so that while liquid can pass into the interiors of the support post structures, it cannot enter the interior of the container. The purpose of such support post is to provide further rigidity for the containers and to permit additional means of access of the fluid into heat exchange relationship with the contents of the containers.

As also shown particularly in FIGS. 3 and 5, the forward portion of the container, which is defined as that region adjacent to and including the mouth of the container, has a substantially convex surface 18 which slopes symmetrically to a centrally disposed mouth 20, which is seen sealed in closed position by a cap 21. The convex surface 18 at the forward portion of the container is generally matched at the rearward portion of the container by a substantially concave surface 22. Concave surface 22 is symmetrical and has a slope generally adapted to match the slope of convex surface 18. Additionally, concave surface 22 teminates centrally and inwardly in an indentation 23, which is generally adapted to hold the mouth 20 and its cap 21 therewithin.

As seen in FIG. 4, the male mating members extend upwardly a significant dimension above the plane of the top wall 14 of container 13. However, in FIG. 4 the matching indentations 19 in the bottom wall 15 of the container are not seen, since they are not apparent in the side elevation of FIG. 4, nor is the depth of the female die parts 19 apparent in the bottom plan view of FIG. 5. Such contrast between the upward extension of the male parts 16 and indentation of the female parts 19 is best seen in FIG. 6, which shows that the male mating members 16 extend upwardly by an amount of about three times the depth of the indentations 19 in the bottom wall 15.

Figure 6:
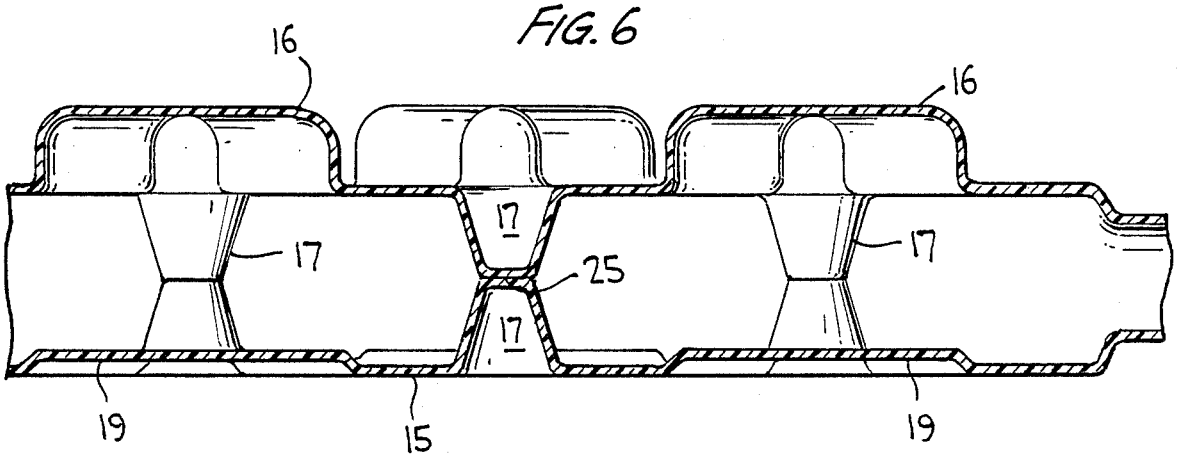
FIG. 6 is a vertical section of the container, taken along the line 6—6 of FIG. 3.

Although the side wall 23 of the container is not shown in FIG. 6, it will there be apparent that the support means 17 consists of upper and lower indentations which, in this preferred embodiment are fused to each other at location 25 by the material from which the containers, themselves, are formed. At the present time it is preferred that the containers be made from high density polyetheylene. This support structure or post 17 furnishes additional contact area between a fluid pasing around and about the containers with the contents of the containers, in addition to rigidifying the container so that, in a stack of a considerable number, e.g., 20 containers high, the containers on the bottom of the stack will be able to support the considerable weight of the containers above them.

Figure 7:
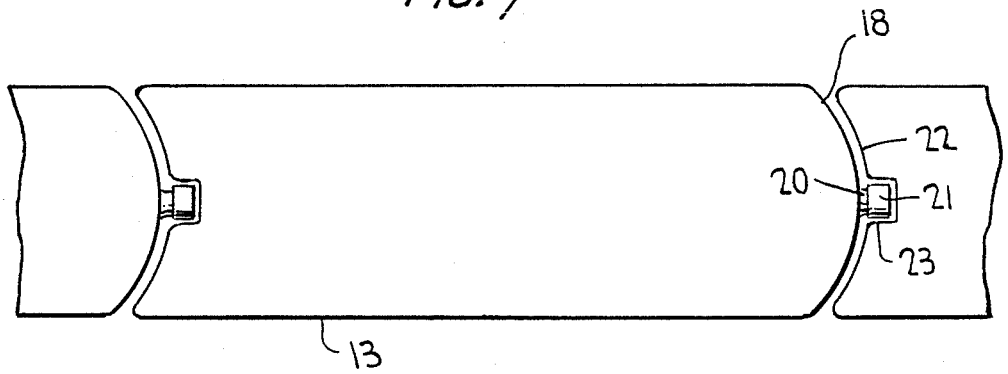
FIG. 7 is a plan view illustrating the nesting of abutting containers.

The nesting feature of the invention is best illustrated in FIG. 7 of the drawing. In this view, several containers 13 are shown arranged in end to end relationship. As so disposed, the forward portion of any container 13 is located so that the convex surface 18 is adjacent to the concave surface 22 of the next abutting container. In such position, the container mouth 20 and cap 21 are disposed within the indentation or notch 23 in the rearward portion of adjoining container. As so illustrated, the containers are slightly spaced with regard to the dispositon of the convex surface 18 of one container and the concave surface 22 of the next container. However, it will be understood that such disposition is for the purposes of illustration only, and that in many instances the convex and concave surfaces will actually be in abutting and touching relationship, so that the stack of containers will be able to better support itself.

Figure 8:
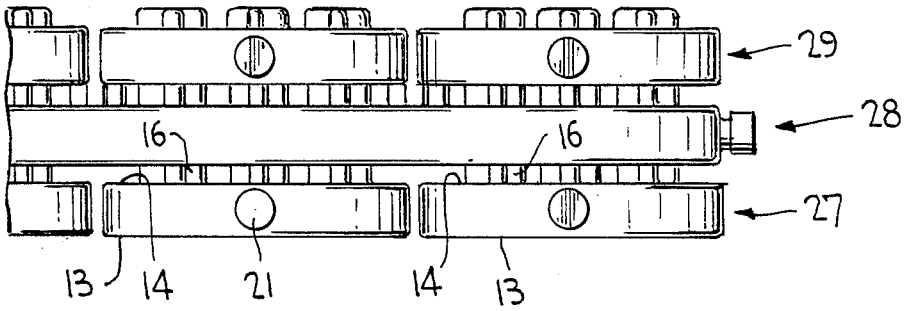
FIG. 8 is a side elevational view showing a rack of three rows of containers in the preferred configuration.

With regard to such support, FIG. 8 illustrates a three-high rack of containers, with alternate tiers being disposed perpendicular to each other. Thus, in FIG. 8, the lowermost tier 27 of containers 13 has all the containers arranged in parallel relationship with the forward and rearward portions thereof all pointing in the same direction so that the caps 21 are all illustrated facing the viewer. Also, the male members 16 all extend from the upper surfaces of the top walls 14 of the containers. In this side elevational view, the next upwardly located tier 28 of containers are arranged at a 90° angle to the tier 27, and these containers also have their forward portions disposed in the same direction. Then, in the illustration of FIG. 8, the next tier 29 of containers is positioned in a manner to duplicates that of tier 27. In each of tiers 27, 28 and 29, the female mating members 19 in the bottom walls 16 of the containers are not seen. However, those female mating parts have a configuration as best shown in FIG. 5, which corresponds to the male mating members 16 so that a male part 16 will be retained by the corresponding female part 19 either when the containers are arranged in superposed rows that are parallel or perpendicular to each other.

As will be seen in FIG. 8, when arranged in such manner the containers 13 present a unitary rack which is self-supporting and nesting, but through which a fluid can pass into intimate, heat exchange relationship with the contents of the container. In this manner when it is a desire to freeze the contents of the containers, a chilled fluid, usually water or air, will be passed through the enclosure for the containers from one end to the other so that the fluid, which is at a lower temperature than the eutectoid composition within the containers, will serve to lower the salt composition temperature to that of the fluid. Then, when it is desired to cool a fluid that is warmer than the temperature of the eutectoid salt composition within the containers, the warm fluid may again be passed through the enclosure for the containers. When that fluid is now brought into intimate, heat exchange relationship with the containers, the temperature of the fluid is brought to the temperature of the salt compositions, and thereby chilled for use, for example, in the air conditioning of buildings.

While the present invention has been shown and described with respect to a specific embodiment thereof, it will be understood by those of skill in this art that such disclosure has been provided for the purpose of illustration only. I desire that my invention be given the benefit of such alterations and modifications as would be made in this disclosure by those of skill in the art, and ask that my invention be limited only by the scope, including equivalents, of the following, appended claims.

I claim:

1. A nestable, stackable container comprising a continuous container body capable of being rapidly filled with and retaining a viscous liquid therein and having top and bottom walls joined by continuous side walls extending around the periphery of the container body, said container body having a forward portion terminating in a forwardly extending mouth part to provide access to the interior of the container, and a rearward portion thereof, and comprising (a) male or female die parts located on said top wall and adapted to cooperate with mating die parts on the botom wall of another container;

(b) male or female die parts located on said bottom wall adapted to cooperate with mating die parts on the top wall of another container;

(c) said forward portion of said container having a substantially convex curvilinear surface sloping continuously from said side walls to said mouth portion without intermediate shapes that upon rapid filling with said viscous liquid, will trap air within said container body;

(d) said rearward portion of said container being formed with a substantially concave curvilinear surface sloping continuously from said side walls and conforming generally to the slope of the convex surface of said forwrad portion, so that a plurality of containers are stackable by mating male and female die parts on said top and bottom walls of said container, and nestable by juxtaposition of said convex and concave surfaces of a plurality of said containers, said surfaces being capable of contiguous relationship over major portions thereof whereby said convex and concave surfaces are in abutting and touching relationship so that a stack of containers will be better able to support itself.

2. A nestable, stackable container as claimed in claim 1, in which said male die parts are formed on the top wall of said container and said female die parts are formed in the bottom wall of said container.

3. A nestable, stackable container as claimed in claim 1 or claim 2, in which said male die parts are hollow and extend outwardly beyond the plane of said top wall of said container body.

4. A nestable, stackable container as claimed in claim 1, in which said male and female die parts cooperate with each other in at least two different positions of alignment.

5. A nestable, stackable container as claimed in claim 6, in which said two different positions of alignment are radially spaced from each other by 90°.

6. A nestable, stackable container as claimed in claim 1, in which said mouth part is centrally located between said side walls, and the slope of said convex surface is gradual and uniform on each side of said mouth part.

7. A nestable, stackable container as claimed in claim 1, in which said substantially concave surface of said rearward part has a notched portion centrally located between said side walls in position to mate with said mouth part, and the slope of said concave surface is gradual and uniform on each side of said notch portion.

8. A rack of nestable, stackable containers as claimed in claim 1, in which (a) said male die parts extend outwardly from said top or bottom walls of said containers, (b) said female die parts are indented into the bottom or top walls of said containers, and (c) said male die parts extend outwardly from said walls of said containers by a distance greater than the depth of the indentations of said female die parts into said walls of said containers, so that when said containers are stacked, the top wall of one container is separated from the bottom wall of the next upper container by a distance equal to the differential between the outward extension of said male die parts and the indentation of said female die parts.

9. A rack of containers as claimed in claim 8, in which said containers are arranged in horizontal tiers, the containers of at least two adjoining tiers being positioned parallel to each other.

10. A rack of containers as claimed in clai 8, in which said containers are arranged in horizontal tiers, the containers in at least one of said tiers being disposed perpendicular to the containers in a contiguous tier.

11. A rack of containers as claimed in claim 8, in which the containers are arranged in alternate, horizontal tiers, the containers in one of said tiers being positioned parallel to each other, and the containers in contiguous tiers both above and below said one tier having their containers parallel to each other but normal to the containers in said one tier.

* * * * *